United States Patent [19]

Wiegand

[11] Patent Number: 4,611,781

[45] Date of Patent: Sep. 16, 1986

[54] SUPPORT STAND IN PARTICULAR FOR HOLDING TREES TO BE PUT UP

[76] Inventor: Martin Wiegand, Otto-Efferenstr. 38, 7712 Blumberg, Fed. Rep. of Germany

[21] Appl. No.: 642,446

[22] Filed: Aug. 20, 1984

[30] Foreign Application Priority Data

Aug. 24, 1983 [DE] Fed. Rep. of Germany ..... 3330463

[51] Int. Cl.[4] ..... F16M 13/00

[52] U.S. Cl. ..... 248/526; 248/529

[58] Field of Search ..... 248/516, 523, 524, 525, 248/526, 527, 514, 515, 529; 47/40.5

[56] References Cited

U.S. PATENT DOCUMENTS

| | | | |
|---|---|---|---|
| 694,867 | 3/1902 | Krick | 248/524 |
| 883,235 | 3/1908 | Rauch | 248/526 |
| 1,028,787 | 6/1912 | Rossmeissl | 248/525 |
| 2,023,340 | 12/1935 | Peskulich | 248/524 |
| 2,297,191 | 9/1942 | Parman | 248/524 |
| 2,476,225 | 7/1949 | Schroeder | 248/526 X |
| 2,477,981 | 8/1949 | Havery | 248/527 X |
| 3,337,169 | 8/1967 | Griffin | 248/527 X |
| 3,693,918 | 9/1972 | Fisher et al. | 248/524 |
| 4,159,096 | 6/1979 | Chase | 248/523 |

FOREIGN PATENT DOCUMENTS

| | | | |
|---|---|---|---|
| 888037 | 12/1971 | Canada | 248/525 |

*Primary Examiner*—J. Franklin Foss

*Attorney, Agent, or Firm*—Bachman & LaPointe

[57] ABSTRACT

A support stand, in particular for holding trees which are to be put up, comprising a sleeve portion for receiving the stem of the tree therein and support legs which are disposed on the sleeve portion is to be very easy to connect to the tree, is to hold the tree in the position of use in a satisfactory manner and is also to be removable from the tree again without serious difficulty.

For that purpose it is provided that the support legs are joined to the sleeve portion by way of a hinge and engage over the sleeve portion by means of a holder, over a given length. The holder is in the form of a point and can be engaged into the wood of the stem of the tree.

1 Claim, 3 Drawing Figures

SUPPORT STAND IN PARTICULAR FOR HOLDING TREES TO BE PUT UP

BACKGROUND OF THE INVENTION

The present invention relates to a support stand, in particular for holding trees which are to be put up, having a sleeve portion which receives the stem of the tree therein and support legs which are disposed on the sleeve portion.

Support stands of that kind are known in particular as Christmas tree stands, but they are also used in museums, galleries or the like. They are generally intended to hold plants and in particular trees, which are provided for decorative purposes.

Sleeve portions which are made from cast iron and which are surrounded by legs bearing ornamentative decoration are used for example as Christmas tree support stands. The sleeve portions are then pierced by screw members which, after the tree or the plant has been fitted into the sleeve portion, are screwed into the tree. That process is very irksome to carry out and involves considerable physical effort and exertion on the part of the person using the stand.

The object set by the present inventor was that of developing a support stand of the general kind indicated, which can be very easily fitted to a tree but which holds the tree in the position of use in a highly satisfactory manner and which can also be removed from the tree again, without major difficulties.

That object is achieved in that the support legs are connected to the sleeve portion by way of a joint or hinge means and engage with a tree holding means over the sleeve portion over a given length.

SUMMARY OF THE INVENTION

In the construction according to the invention, the hinge means is so arranged on the sleeve portion that the tree holding means only engage the tree when it is put up in its position of use. Preferably, the holding means is to be a simple point which bores into the stem of the tree.

In that arrangement, the hinge comprises two plate or bar members which accommodate a support leg therebetween. The connection between the respective components is made by a simple screw with a nut screwed thereon. The support legs or plate or bar members are respectively so arranged that the support legs are movable in a given direction in the plane of the longitudinal axis of the sleeve portion. With that movement, it is intended that the point can be removed from or engaged into the tree.

A further improvement in respect of the hinge provides that formed on the plate or bar portions substantially normal thereto is a tongue portion which engages under a ring member secured to the bottom of the sleeve portion. The fixing on the ring is preferably formed by a simple screw so that in the event of the hinge wearing, it can be easily replaced.

The full effect of the 'automatic' action of holding a tree occurs when the support leg bears with the base thereof against a support structure, for example the floor. The tree holder is then intended to engage over the sleeve, at a predetermined length, and to bore into the stem of the tree. In that case, the ring at the bottom of the sleeve portion will generally also be arranged in parallel relationship to the surface of the support structure on which the support stand stands.

It is in accordance with the invention for the support legs each to imitate or resemble a human foot, with the support legs being mounted to the sleeve portion with an angle of about 120° between them. In the position of use, that is to say, after the stem of the tree has been fitted into the sleeve portion, each support leg is intended to bear against the support structure on which the stand stands, by means of the heel and the ball of the imitation foot. In that condition, points which project from the Achilles tendons must bore into the stem of the tree.

Another embodiment of the support legs lies in the imitation of a dwarf or gnome. The dwarf or gnome sits with his buttocks on the surface of the support structure on which the tree is to be erected, with his heels also resting on the support surface. In that embodiment, the rearwardly projecting tip portion of a pointed cap worn by the dwarf or gnome bores into the tree.

If the support stand is to be used as a Christmas tree stand, then the support legs may be designed with different motifs or configurations. In addition, the support legs may be interchanged depending on the particular occasion involved.

BRIEF DESCRIPTION OF THE INVENTION

Further features, advantages and details of the invention will be apparent from the following description of preferred embodiments and with reference to the accompanying drawings in which.

DETAILED DESCRIPTION

Figure 2:
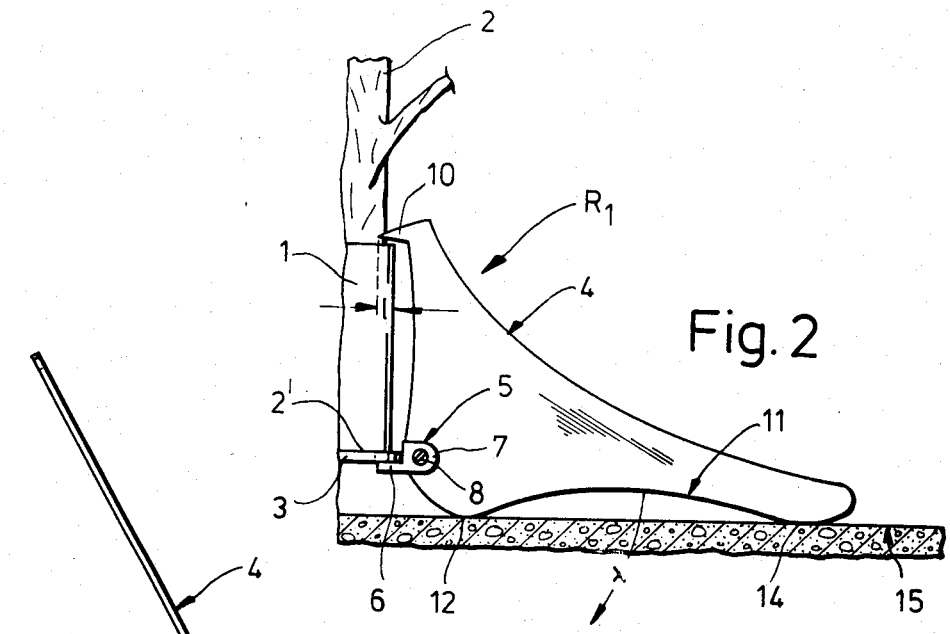
FIG. 2 shows a side view of part of a tree support stand in the position of use thereof.
Figure 1:
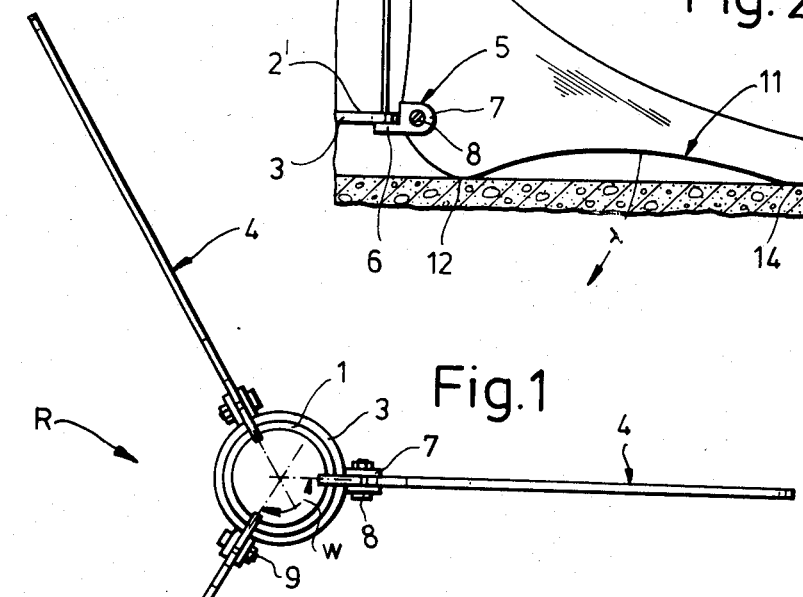
FIG. 1 shows a plan view of a tree support stand according to the invention.
Figure 3:
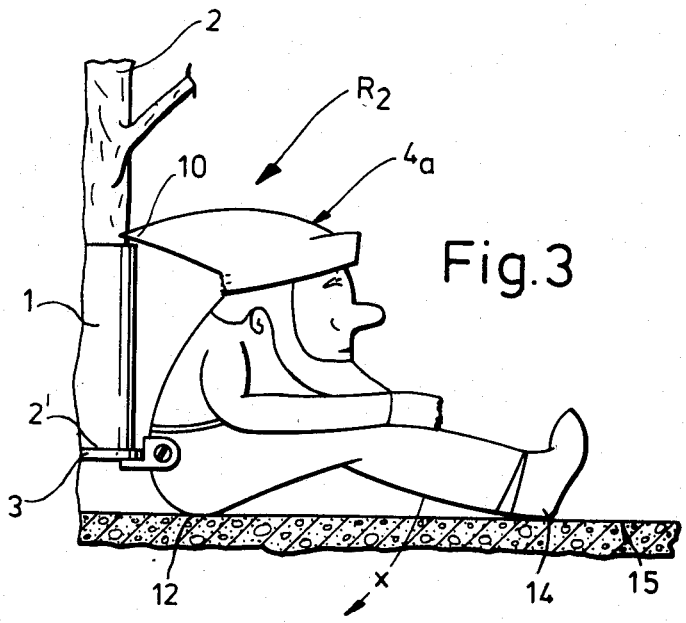
FIG. 3 shows a further embodiment of a tree support stand in the position of use.

Referring to FIG. 1, a tree support stand R comprises a cylindrical sleeve portion 1 for receiving a tree 2 or the like (see also FIGS. 2 and 3). Secured to the bottom 2' of the sleeve portion 1 is a ring 3 from which support legs 4 project. In the illustrated arrangement, the support legs 4 are disposed at an angle w of 120° relative to each other.

The support legs 4 are fixed to the ring 3 by way of a respective joint or hinge 5; a tongue portion 6 engages under the ring 3 while from the tongue portion 6 project two parallel plate or bar portions 7 which are arranged normal thereto and which hingedly accommodate between them a support leg 4, by means of a screw 8 with nut 9. The hinge 5 permits movement of the support leg 4 in the direction indicated by x.

In the position of use (see FIGS. 2 and 3), points 10 on the support legs 4 engage over the sleeve portion 1, with the points 10 boring into and holding the tree 2. For that purpose, the support leg 4 must be of such a configuration that the base or sole 11 of the leg 4 bears in its entirety (not shown) or at individual locations as indicated by 12 and 14 respectively, against a flat support structure 15, when the tip 10 engages over the sleeve portion 1, over a length 1.

In that case, the ring 3 will generally also come to lie substantially parallel to the support surface 15.

Referring to FIG. 2, it is shown therein that the support leg 4 is shaped similarly to a human foot, with one contact location thereof being formed by the heel and the other being formed by the ball of the foot. The tip 10 then projects rearwardly approximately from the Achilles tendon.

FIG. 3 shows another configuration of the support leg $4_a$, in the form of a dwarf or gnome who is sitting on the support surface 15, his buttocks forming the support location 12 and his heels forming the support location 14, while his pointed cap forms the point 10.

I claim:

1. A support stand for holding trees on a flat support structure which comprises: a sleeve for holding the tree having a lower portion and a hollow upper portion for receiving the stem of the tree; a bracket engaging the lower portion of said sleeve including hinge means comprising two plate members extending outwardly therefrom; a tongue portion extending inwardly from said plate members and engaging said bracket; support legs connected to said hinge means having a lower portion bearing on said flat support structure and having an upper portion including tree holding means engaging said tree above said sleeve, said support legs connected to said hinge means be a screw-nut connection so that the support legs are movable in the direction (x), wherein said support legs being in the shape of a gnome seated on the support structure by way of its buttocks and its heel, said gnome having a pointed cap which is seated on the flat support structure with the pointed cap boring into the tree.

* * * * *